US009290034B2

(12) United States Patent
Busam et al.

(10) Patent No.: US 9,290,034 B2
(45) Date of Patent: Mar. 22, 2016

(54) QUICK-MOUNT FOLDER

(71) Applicants: Edward P. Busam, Mason, OH (US); Richard H. Harris, Xenia, OH (US)

(72) Inventors: Edward P. Busam, Mason, OH (US); Richard H. Harris, Xenia, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 93 days.

(21) Appl. No.: 14/062,106

(22) Filed: Oct. 24, 2013

(65) Prior Publication Data

US 2015/0115021 A1 Apr. 30, 2015

(51) Int. Cl.
*B65D 27/00* (2006.01)
*B42F 11/00* (2006.01)

(52) U.S. Cl.
CPC ..... *B42F 11/00* (2013.01)

(58) Field of Classification Search
CPC ..... B42F 7/06; B42F 11/00; B42F 13/008; B42F 1/00
USPC ..... 229/67.1–67.4; 402/79; 281/45
See application file for complete search history.

(56) References Cited

U.S. PATENT DOCUMENTS

| | | | | | |
|---|---|---|---|---|---|
| 717,957 | A * | 1/1903 | Weaver | B42F 13/12 | 281/45 |
| 818,130 | A * | 4/1906 | Swan | B42F 11/00 | 211/45 |
| 1,371,459 | A * | 3/1921 | Amlie | 402/79 | |
| 2,153,575 | A * | 4/1939 | Irving | B42F 3/003 | 281/45 |
| 2,599,768 | A * | 6/1952 | Losch, Jr. | 402/79 | |
| 2,911,977 | A * | 11/1959 | French | B42F 13/08 | 281/21.1 |
| 4,551,039 | A * | 11/1985 | Basseches | 402/60 | |
| 4,595,309 | A * | 6/1986 | Chinchar | B42F 11/00 | 402/80 R |
| 5,125,561 | A * | 6/1992 | Idstein | 229/400 | |
| 5,335,027 | A * | 8/1994 | Lin et al. | 353/120 | |
| 5,417,509 | A * | 5/1995 | Schwartz | 402/79 | |
| 5,697,646 | A * | 12/1997 | Venegas | B42B 5/10 | 281/37 |
| 6,168,340 | B1 | 1/2001 | Lehmann et al. | | |
| 6,196,748 | B1 * | 3/2001 | Schwartz | 402/8 | |
| 6,196,750 | B1 * | 3/2001 | Hansen | 402/79 | |
| 6,382,864 | B1 * | 5/2002 | Moor | 402/79 | |
| 6,412,819 | B1 * | 7/2002 | Paine | B42F 13/0006 | 281/21.1 |
| 6,666,610 | B1 * | 12/2003 | Moor et al. | 402/79 | |
| 7,237,805 | B2 * | 7/2007 | Fasan et al. | 281/29 | |
| 2015/0048610 | A1 * | 2/2015 | Harris | B42D 1/007 | 281/45 |

OTHER PUBLICATIONS

"Mead Five Star Two Pocket Snap-in Poly Portfolio" from website of The Douglas Stewart Co., http://www.dstewart.com/five-star-2-pocket-snap-in-poly-portfollo.html (retrieved from the internet on Oct. 9, 2013).

* cited by examiner

*Primary Examiner* — Jes F Pascua
(74) *Attorney, Agent, or Firm* — Thompson Hine LLP

(57) ABSTRACT

A folder system including a folder having a first panel and a second panel pivotally coupled to the first panel along a pivot line. The folder further includes a spine portion positioned between the first and second panels at the pivot line, wherein said spine portion includes a hole formed therethrough. The spine portion further includes a slit extending from an outer edge of the spine portion to the hole to enable a binding device to be passed through the slit into the hole.

24 Claims, 4 Drawing Sheets

QUICK-MOUNT FOLDER

The present invention is directed to a folder, and more particularly, to a folder which can be quickly coupled to a binding device.

BACKGROUND

School and office products, such as folders, filers, portfolios, pockets, storage devices and the like (collectively termed a "folder" herein) are often utilized to store papers and other loose items. In many cases, it is desired to secure the folder to a binding device, such as a three-ring binder/binding device. However, many existing systems utilize binding holes which require the binding device to be opened and closed to couple the folder to the binding device.

SUMMARY

Accordingly, in one embodiment, the present invention is a folder which provides a quick and easy connection to a binding device. More particularly, in one embodiment the present invention is a folder system including a folder having a first panel and a second panel pivotally coupled to the first panel along a pivot line. The folder further includes a spine portion positioned between the first and second panels at the pivot line, wherein said spine portion includes a hole formed therethrough. The spine portion further includes a slit extending from an outer edge of the spine portion to the hole to enable a binding device to be passed through the slit into the hole.

DETAILED DESCRIPTION

Figure 1:
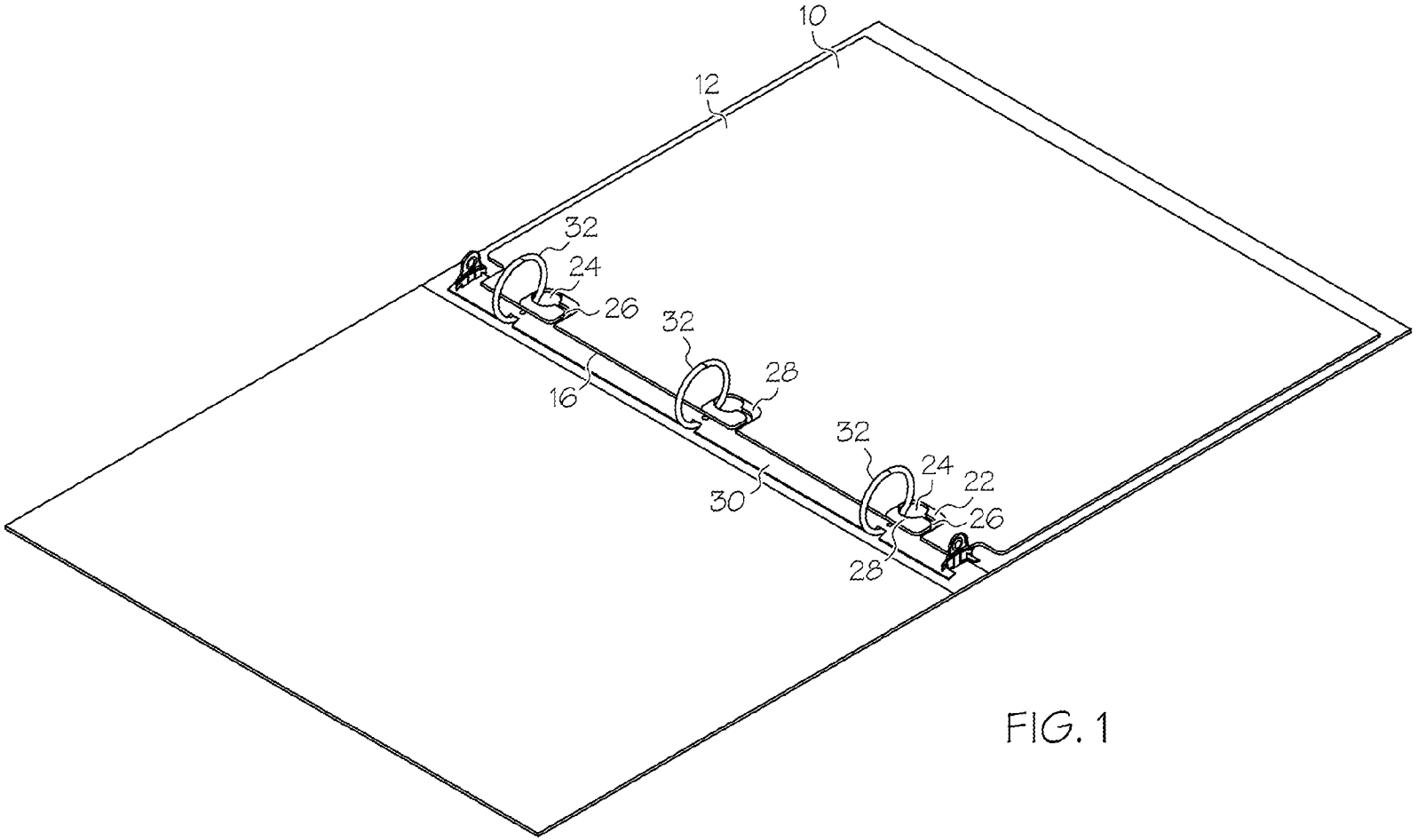
FIG. 1 is an upper perspective view of one embodiment of a folder, shown in conjunction with a three-ring binding device.
Figure 2:
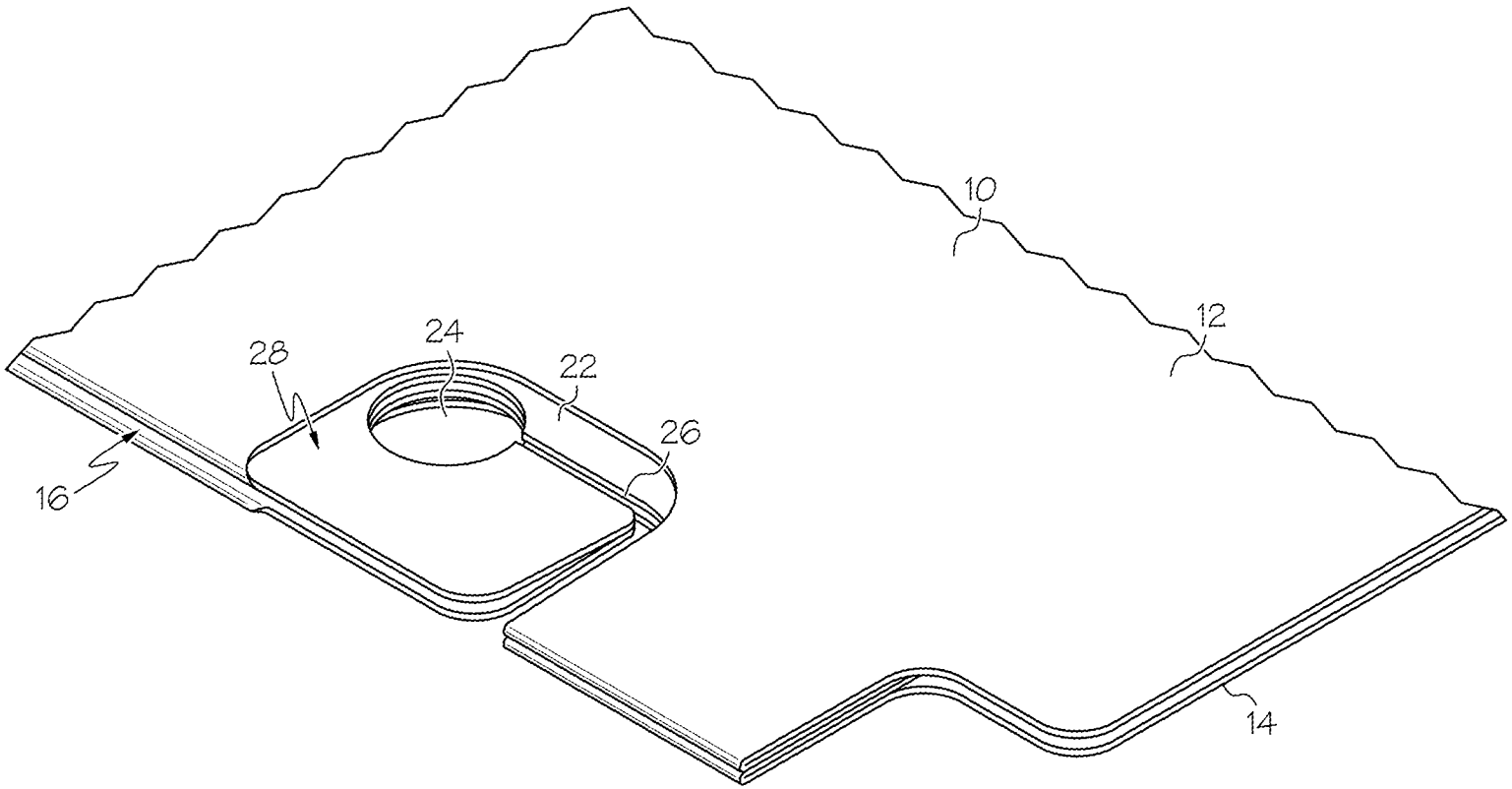
FIG. 2 is a detail view of part of the folder of FIG. 1, shown without the three-ring binding device.
Figure 3:
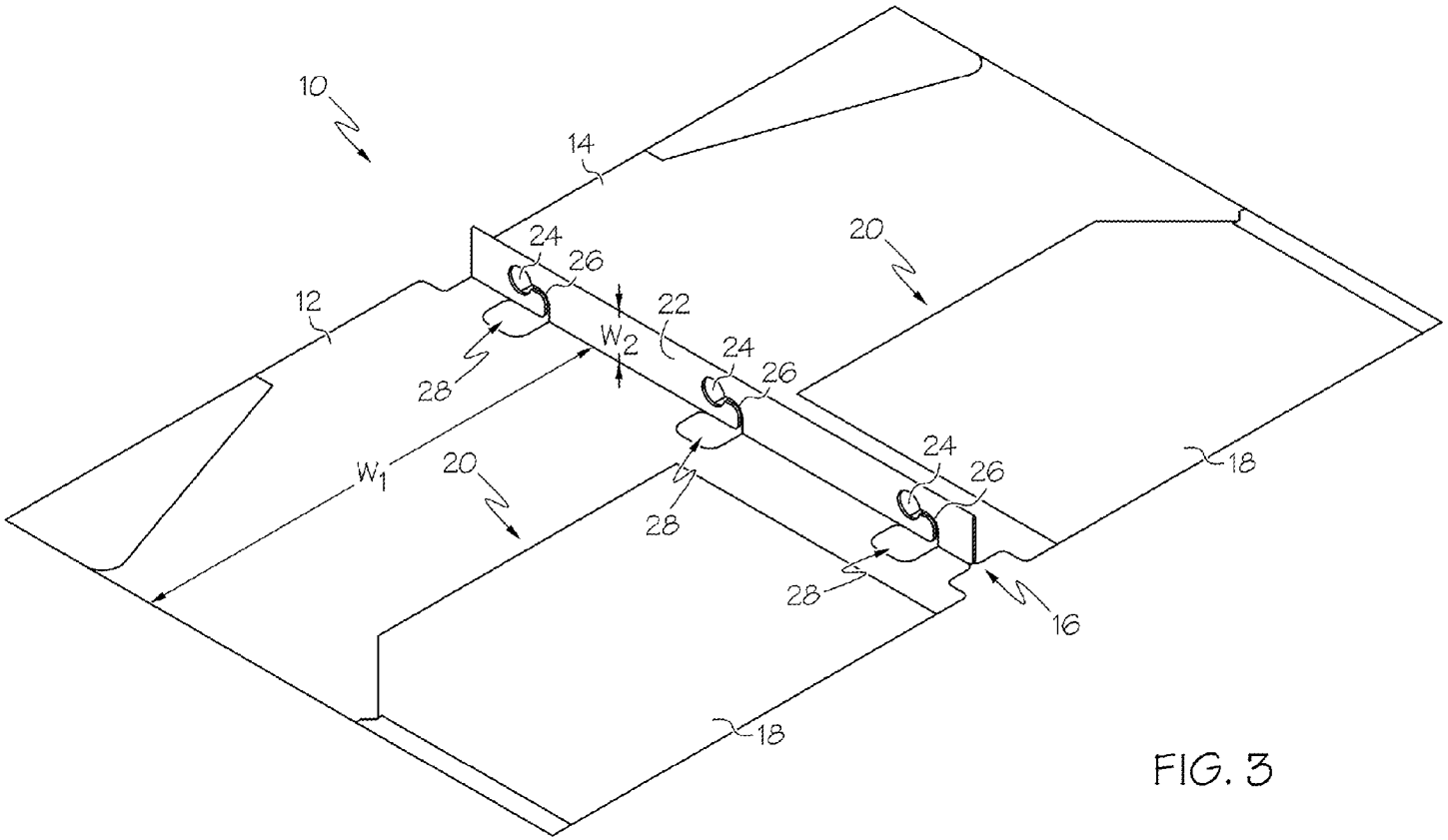
FIG. 3 is an upper perspective view of the folder of FIG. 1, shown in its open position.

In one embodiment, shown in FIGS. 1-4, the folder 10 can include a first panel 12 and a second panel 14 pivotally coupled together along a pivot line or fold line 16. In the illustrated embodiment each panel 12, 14 is generally flat and planar, and generally rectangular in top view. With reference to FIG. 3, the first and second panels 12, 14 may each include a pocket panel 18 coupled to an inner surface thereof to define a pocket 20 therebetween such that papers and other loose items can be positioned in each pocket 20. It should be understood that the shape and configuration of the first 12 and second 14 panels, pocket panels 18 and pockets 20 can be varied as desired. It should be further understood that the folder 10 may not necessarily include any pocket panels 18/pockets 20.

The folder 10 may also include a spine or spine portion 22 positioned between the first 12 and second 14 panels at the pivot line 16. In one embodiment, the spine 22 is made of two plies of material, wherein the plies are facially abutting (such as by folding a piece of material) and optionally joined together by adhesives, mechanical joining devices or the like. However, the plies may not necessarily be joined together, and alternatively the spine 22 can include only a single ply.

The first 12 and second 14 panels can each have a height extending generally parallel to the pivot line 16, and a width $w_1$ (FIG. 3) extending generally perpendicular to the pivot line 16. In the illustrated embodiment, the first 12 and second 14 panels have generally the same width, and the spine 22 has a width $w_2$ (FIG. 3) less than the width $w_1$ of the first 12 and second 14 panels. In one case the width $w_2$ is less than about 25%, or less than about 10% of the width $w_1$.

In one embodiment the first panel 12, second panel 14 and spine 22 (including both plies, if a two-ply spine is utilized) can be formed of a single unitary piece of material. Alternatively, however, if desired the various panels 12, 14 and spine 22 can be made of different pieces of material joined together. The folder 10/panels 12, 14/spine 22 can be made of any wide variety of materials including but not limited to polymers (including plastic), cardboard, paper, polymer-coated paper or cardboard, fabric coated paper or cardboard, etc.

The folder 10 may be moveable between a closed position (FIGS. 1 and 2) wherein the first 12 and second 14 panels are generally parallel and facing each other, with the spine 22 positioned therebetween, and an open position (FIGS. 3 and 4) wherein the first 12 and second 14 panels are generally parallel and not facing each other. The first 12 and second 14 panels can each include an outer perimeter that is generally aligned when the folder 10 is in its closed position, and the spine 22 can be internally positioned in the folder 10 such that the spine 22 is generally positioned within each outer perimeter when the folder 10 is in its closed position. In this manner, the spine 22 may be positioned between the first 12 and second 14 panels such that the folder 10 has at least a three-ply thickness along a straight line extending through the folder 10 (i.e. in a direction perpendicular to the panels 12, 14) in the area of the spine 22. When the folder 10 is in its open position (FIGS. 3 and 4) in one embodiment the spine 22 can be positioned generally perpendicular to the first 12 and second 14 panels.

As best shown in FIG. 3, the spine 22 can include a plurality of holes 24 formed therethrough and spaced along a length thereof. The spine 22 can also include a slit 26 associated with each hole 24, wherein each slit 26 extends from the hole 24 to an outer edge of the spine 22. Thus, each slit 26 can extend to and intersect the outer edge of the spine 22 and/or pivot line 16 whereas each hole 24 can be entirely spaced apart from and not intersect the associated outer edge/pivot line 16. Each slit 26 can have a generally non-linear shape, and in the illustrated embodiment forms a generally "L" shape having a 90° bend. Each slit 26 can take the form of a cut formed through the spine 22, or material removed therefrom. In one case each slit 26 has a width less than the maximum width (diameter) of the associated hole 24.

The first 12 and second 14 panels may each include a cutout 28, wherein each cutout 28 is generally aligned with an associated hole 24/slit 26. Each cutout 28 can be positioned on/intersect an inner edge of the associated panel 12, 14 and/or the pivot line 16. In particular, as shown in FIGS. 1 and 2, each cutout 28 may be configured to provide access to the associated hole 24 and/or slit 26. The cutout 28 of each panel 12, 14 exposes/uncovers the underlying hole 24/slit 26 when the folder 10 is in its closed position. In this manner, each cutout 28 provides access to the hole 24/slit 26 and enables the coupling/uncoupling process, as described in greater detail below.

Figure 4:
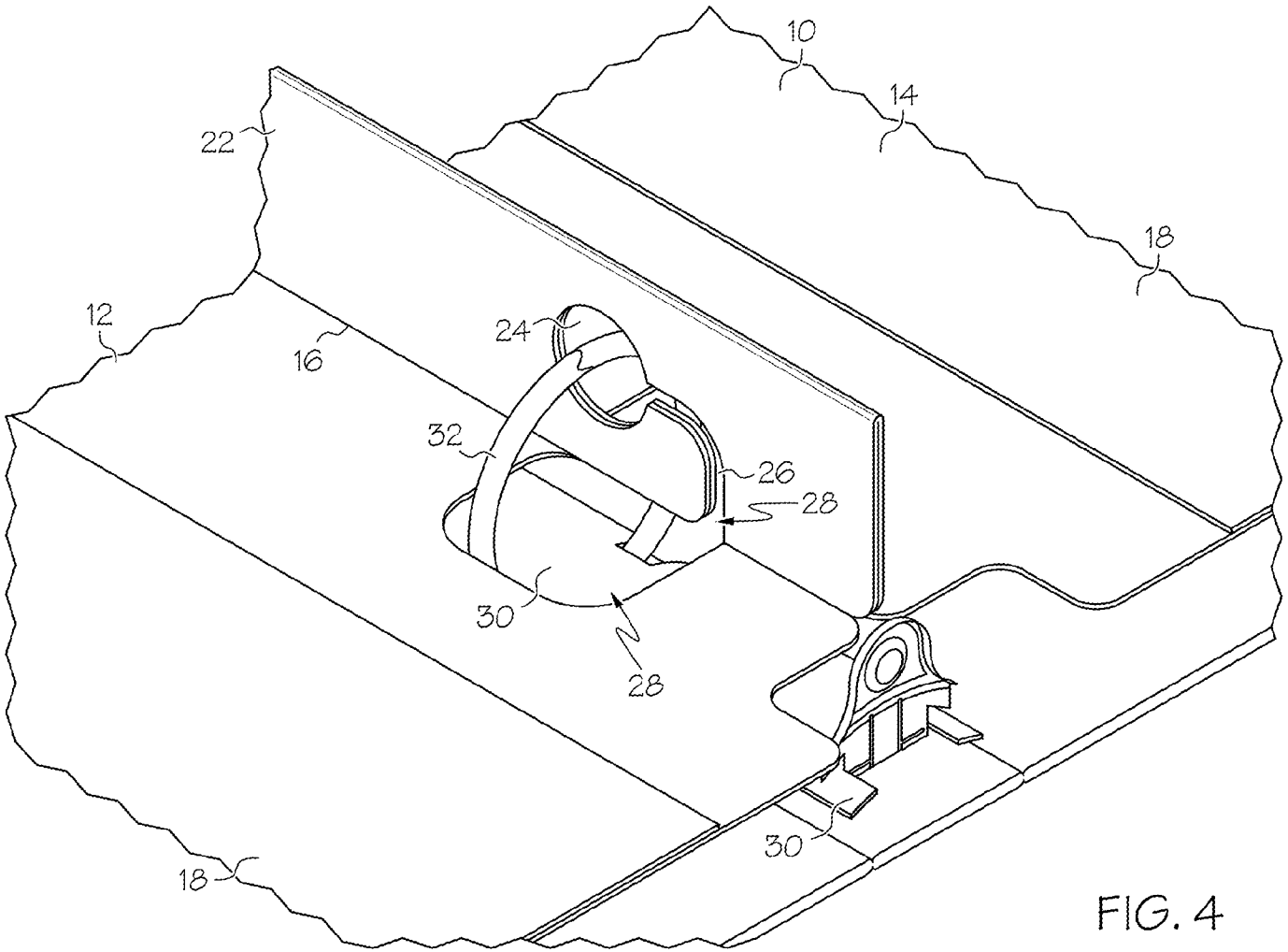
FIG. 4 is an upper perspective view of part of the folder and binding device of FIG. 1, with the folder in its open position.

FIG. 3 illustrates three discrete cutouts 28, but if desired a single large cutout 28 can extend along each of the panels 12/14 to provide access to the holes 24/slits 26. Each cutout 28 can extend in the width direction sufficiently to allow a binder ring 32 to pass therethrough unimpeded when the folder 10 is laid flat in its open position, as shown in FIG. 4. When the folder 10 is in the closed position, the first 12 and second 14 panels may cover the entirety/remainder of the spine 22, except for those portions exposed by the associated cutouts 28. For example, as shown in FIG. 1, no portions of the spine 22 are visible, except those portions exposed by the cutouts 28. This arrangement provides strength to the folder 10, a cleaner appearance, and reduces chances of the spine 22 being snagged on other components which may be stored with the binding device 30.

The holes 24/slits 26/cutouts 28 enable the folder 10 to be easily coupled/bound to, and decoupled/unbound from a binding device 30. In the illustrated embodiment the binding device 30 takes the form of a three ring binder including three binding rings 32, and each hole 24/slit 26/cutout 28 is spaced and configured to be aligned with an associated binding ring 32. In order to couple the folder 10 to the binding device 30, each ring 32 is passed through an associated slit 26 until the ring 32 is fully seated in the associated hole 24.

Each hole 24 is illustrated as being circular in the illustrated embodiment, and having a diameter/size/area greater than the cross-sectional area of the associated ring 32. However, each hole 24 can take any wide variety of other shapes and configurations, so long as the holes 24 are, in one case, shaped to entirely receive a ring 32 therethrough. The non-linear configuration of the slits 26 helps to ensure each ring 32 remains securely positioned in the associated hole 24, and is not inadvertently separated. In addition, in the illustrated embodiment each slit 26 has a width smaller than a width of the associated ring 32 to prevent the ring 32 from inadvertently passing through a slit 26. The folder 10 can be uncoupled from each ring 32 by simply passing the ring 32 back through the associated slit 26 to retract the ring 32 out of the associated hole 24 and slit 26.

The embodiment shown in FIGS. 1-4 utilizes three sets of holes 24/slits 26/cutouts 28, corresponding to the three rings 32 of the binding device 30. However, it should be understood that the number of holes 24/slits 26/cutouts 28 may not necessarily correspond to the number of rings 32. For example, in the embodiment of FIGS. 1-4, if desired, only one set of holes 24/slits 26/cutouts 28 may be utilized to secure the folder 10 to the binding device 30. In this case, other structures, such as through-holes in the folder 10 may be provided (if at all) at the position of the other rings 32 to enable coupling of the folder 10. In addition, the size, shape and arrangement of the holes 24/slits 26/cutouts 28 can be varied as desired to couple the folder 10 to various other binding devices. For example, the folder 10 may be configured to be releasably coupled to wire binding devices, such as spiral or coil binding devices, twin-wire binding devices, etc. using one or more sets of holes 24/slits 26/cutouts 28. In addition, the embodiment of FIGS. 1-4 illustrates the folder 10 as including both first 12 and second 14 panels. However, if desired, the folder 10 may include only a single panel, and the other panel can be omitted.

Accordingly, as can be seen, the folder disclosed herein can be quickly coupled to, and decoupled from, a binding device, such as a three-ring binding device or the like, without having to open or close the binding device. The folder can be relatively easy and inexpensive to manufacture, and is simple and intuitive to use.

Having described the invention in detail and by reference to the various embodiments, it should be understood that modifications and variations thereof are possible without departing from the scope of the claims of the present application.

What is claimed is:

1. A folder system including a folder comprising:

a first panel;

a second panel pivotally coupled to said first panel along a pivot line; and a spine portion positioned between said first and second panels at said pivot line, wherein said spine portion includes a hole formed therethrough, said spine portion further including a slit extending from an outer edge of said spine portion to said hole to enable a binding device to be passed through said slit into said hole, wherein the first and second panels each include a cutout generally aligned with the hole, and wherein said spine portion has a length extending parallel to said pivot line that is greater than a length of at least one of said cutouts.

2. The folder system of claim 1 wherein the first and second panels each include an outer perimeter, and wherein when the folder is in a closed position said spine portion is internally positioned in said folder such that the spine portion is generally positioned within each outer perimeter.

3. The folder system of claim 1 wherein said folder is movable between a closed position, wherein said first and second panels are generally parallel and facing each other, and an open position wherein said first and second panels are generally parallel and not facing each other, and wherein each cutout provides direct access to the hole when the folder is in the closed position.

4. The folder system of claim 3 wherein each cutout intersects an outer edge of the associated panel.

5. The folder system of claim 3 wherein each cutout provides direct access to the entirety of the slit and hole when the folder is in the closed position, and wherein the first and second panels cover a remainder of said spine portion not exposed by any cutout when said folder is in the closed position.

6. The folder system of claim 3 wherein said spine portion is positioned between said first and second panels when said folder is in said closed position such that said folder has at least a three ply thickness along a straight line extending through said folder in an area of said spine portion.

7. The folder system of claim 3 wherein said spine portion is positionable generally perpendicular to said first and second panels when said folder is in said open position.

8. The folder system of claim 1 wherein said slit extends to and intersects said pivot line, and wherein said cutout extends to and intersects said pivot line.

9. The folder system of claim 1 wherein the first and second panels each include a cutout generally aligned with the hole, and wherein the system further includes said binding device extending through said hole to thereby bind said folder.

10. The folder system of claim 1 wherein said slit has a non-linear configuration.

11. The folder system of claim 1 wherein said slit has a 90 degree bend therein.

12. The folder system of claim 1 wherein said first and second panels and said spine portion are all made from a single, unitary piece of material.

13. The folder system of claim 1 wherein said spine portion is a two-ply spine portion.

14. The folder system of claim 1 wherein said spine portion includes a first supplemental hole and a second supplemental hole formed therethrough, and further includes a first supplemental slit and a second supplemental slit, each supplemental slit extending from an outer edge of said spine portion to an associated supplemental hole to enable a binding device to be passed through the first and second supplemental slits into the associated first and second supplemental hole.

15. The folder system of claim 1 wherein each first and second panel is generally flat and planar, and has a pocket thereon.

16. The folder system of claim 1 wherein said first and second panels each have a laterally extending width, and wherein said spine portion has a laterally extending width that is less than said widths of said first and second panels.

17. The folder of claim 1 wherein said spine portion has at least one of a different size or shape than each cutout.

18. The folder of claim 1 wherein said spine portion has a length extending parallel to said pivot line that is generally the same as a height of each panel extending parallel to said pivot line.

19. A folder comprising:

a first panel;

a second panel pivotally coupled to said first panel along a pivot line; and a spine portion coupled to said first and second panels at said pivot line, wherein said spine portion includes a hole formed therethrough, said spine portion further including a slit extending from an outer edge of said spine portion to said hole to enable a binding device to be passed through said slit into said hole, wherein said folder is movable between a closed position, wherein said first and second panels are generally parallel and facing each other, and an open position wherein said first and second panels are generally parallel and not facing each other, and said spine portion is positioned directly between and parallel to said first and second panels when said folder is in said closed position.

20. The folder of claim 19 wherein the first and second panels each include a cutout generally aligned with the hole.

21. The folder of claim 19 wherein said spine portion is positioned directly between said first and second panels in a thickness direction extending perpendicular to a plane of at least one of said first or second panel when said folder is in said closed position.

22. A folder comprising:

a panel having a cutout; and a spine portion pivotally coupled to said panel such that said folder is movable to a closed position wherein said panel and said spine are generally parallel and facing each other, said spine portion having a width less than a width of said panel, wherein said spine portion includes a hole formed therethrough and aligned with said cutout, said spine portion further including a slit extending from an outer edge of said spine portion to said hole to enable a binding device to be passed through said slit into said hole, wherein said cutout surrounds said slit and hole to provide direct access to the entirety of the slit and hole when the folder is in a closed position.

23. The folder of claim 22 wherein said spine portion has at least one of a different size or shape than said cutout.

24. The folder of claim 22 wherein said spine portion is a two-ply spine portion.

* * * * *